United States Patent [19]

Komori et al.

[11] Patent Number: 4,877,076

[45] Date of Patent: Oct. 31, 1989

[54] SCREEN UNIT WITH BUILT-IN BLIND

[75] Inventors: Akihiro Komori, Takamatsu; Muneyoshi Hirano, Kurobe, both of Japan

[73] Assignee: Yoshida Kogyo K. K., Tokyo, Japan

[21] Appl. No.: 231,348

[22] Filed: Aug. 11, 1988

[30] Foreign Application Priority Data

Aug. 12, 1987 [JP] Japan ..... 62-124062[U]

[51] Int. Cl.[4] ..... E06B 3/32

[52] U.S. Cl. ..... 160/107; 160/90; 49/380

[58] Field of Search ..... 160/107, 90, 381, ; 49/380, 463, 64

[56] References Cited

U.S. PATENT DOCUMENTS 4,105,352 8/1978 Holdiman ..... 160/381 X 4,538,662 9/1985 Tomita ..... 160/107

FOREIGN PATENT DOCUMENTS 2364395 12/1973 Fed. Rep. of Germany ..... 160/107

*Primary Examiner*—Blair M. Johnson

*Attorney, Agent, or Firm*—Hill, Van Santen, Steadman & Simpson

[57] ABSTRACT

A screen unit with a built-in blind, capable of being mounted on an existing sash at a low cost through simple work. The screen unit comprises: a rectangular unit frame consisting of an upper horizontal frame member, a lower horizontal frame member, a right vertical frame member and a left vertical frame member; an outdoor side glass panel fixedly attached to the outdoor side of the unit sash; an indoor side glass panel member detachably attached to the indoor side of the unit sash; and elongate projections formed integrally respectively with the horizontal and vertical frame members so as to extend along and project from the respective outer surfaces of the corresponding horizontal and vertical frame members, for connection to an existing sash.

11 Claims, 11 Drawing Sheets

SCREEN UNIT WITH BUILT-IN BLIND

BACKGROUND OF THE INVENTION

1. Field of the Invention:

The present invention relates to a screen unit with a built-in blind and, more specifically to a screen unit with a built-in blind which can formed by simply modifying an existing double sliding door, a door or a fixed window for screening an opening of a building, such as a window.

2. Description of the Prior Art:

The screen unit with a built-in blind has been used for a double sliding door, a door or a fixed window. The screen unit with a built-in blind comprises a sash, glass panels set in the sash respectively on the outdoor side and the indoor side, and a blind set in the sash between the glass panels so as to be operated from inside the room. Such a screen unit has excellent shading effect and sound insulating effect, and improves the aesthetic appearance of the room.

Incidentally, there are instances where it is desired to replace an existing ordinary screen unit having only a glass panel, such as a sliding door or window, with a screen unit with a built-in blind, which may most simply be achieved by totally replacing the existing screen unit with the screen unit with a built-in blind. However, such total replacement is considerably expensive. In case the existing screen unit is a fixed window, the window frame fixed to the building in the window opening must be removed by breaking portions of the building surrounding the window frame, and hence the replacement of the fixed window with a window unit with a built-in blind requires large-scale difficult work.

SUMMARY OF THE INVENTION

With the foregoing in view, it is an object of the present invention to provide a screen unit with a built-in blind which can be installed at a reduced cost by dexterously using an existing frame for a sash through simple work.

To achieve the foregoing object, in one aspect of the present invention, there is provided a screen unit with a built-in blind comprising: a rectangular unit frame consisting of an upper horizontal frame member, a lower horizontal frame member and right side and left side vertical frame members; an external glass panel fixedly set in the outdoor side of the unit frame; an internal glass panel detachably set in the indoor side of the unit frame; a blind disposed between the external glass plate and the internal glass plate; ribs formed integrally with the unit frame so as to protrude from the periphery of the unit frame, and connected to the frame members of an existing sash.

A screen unit with a built-in blind in a second aspect of the present invention is characterized in that the unit frame of the screen unit with a built-in blind in the first aspect has tubular base frame members each provided with a groove for receiving an outdoor side glass panel, in the inner surface on the outdoor side thereof, a blind supporting part in the middle of the inner surface thereof, and a glass panel member holding part for holding an indoor side glass panel member, in the indoor side thereof.

A screen unit with a built-in blind in a third aspect of the present invention is characterized in that the glass panel member holding part has a single supporting rail provided on the lower indoor side frame member of the unit frame.

A screen unit with a built-in blind in a fourth aspect in the present invention is characterized in that the glass panel member holding part of the second aspect is a groove for receiving a glass panel retaining member for retaining a glass panel member.

A screen unit with a built-in blind in a fifth aspect in the present invention is characterized in that the ribs of the first aspect are right and left side vertical ribs and upper and lower horizontal ribs, and the vertical ribs and the horizontal ribs being connected to each other at the opposite ends thereof with connecting blocks, respectively.

A screen unit with a built-in blind in a sixth aspect in the present invention is characterized in that the ribs in the first aspect are fitted in the grooves of the existing sash frame for receiving a glass panel.

A screen unit with a built-in blind in a seventh aspect of the present invention is characterized in that the ribs in the first aspect are fastened through a sacrifice frame to the existing sash frame.

A screen unit with a built-in blind in an eighth aspect of the present invention is characterized in that the grooves for receiving a glass panel of the existing sash are formed each by a pair of battens fixedly provided on the outdoor side and indoor side of the corresponding sash frame.

A screen unit with a built-in blind in a ninth aspect of the present invention is characterized in that the ribs of the screen unit with a built-in blind in the fifth aspect are formed at a position corresponding to the indoor side glass panel member for the screen unit with a built-in blind to be installed on the outdoor side, and at a position corresponding to the outdoor side glass panel for the screen unit with a built-in blind to be installed on the indoor side.

A screen unit with a built-in blind in a tenth aspect of the present invention, the ribs in the fifth aspect are formed at a position corresponding to the blind disposed between the indoor side glass panel member and the outdoor side glass panel.

The above and other objects, features and advantages of the present invention will become apparent from the following description of preferred embodiments according to the principle of the present invention taken in conjunction with the accompanying drawings.

DETAILED DESCRIPTION OF THE PREFERRED EMBODIMENTS

The present invention will be described more specifically hereinafter with reference to the accompanying drawings.

Figure 6:
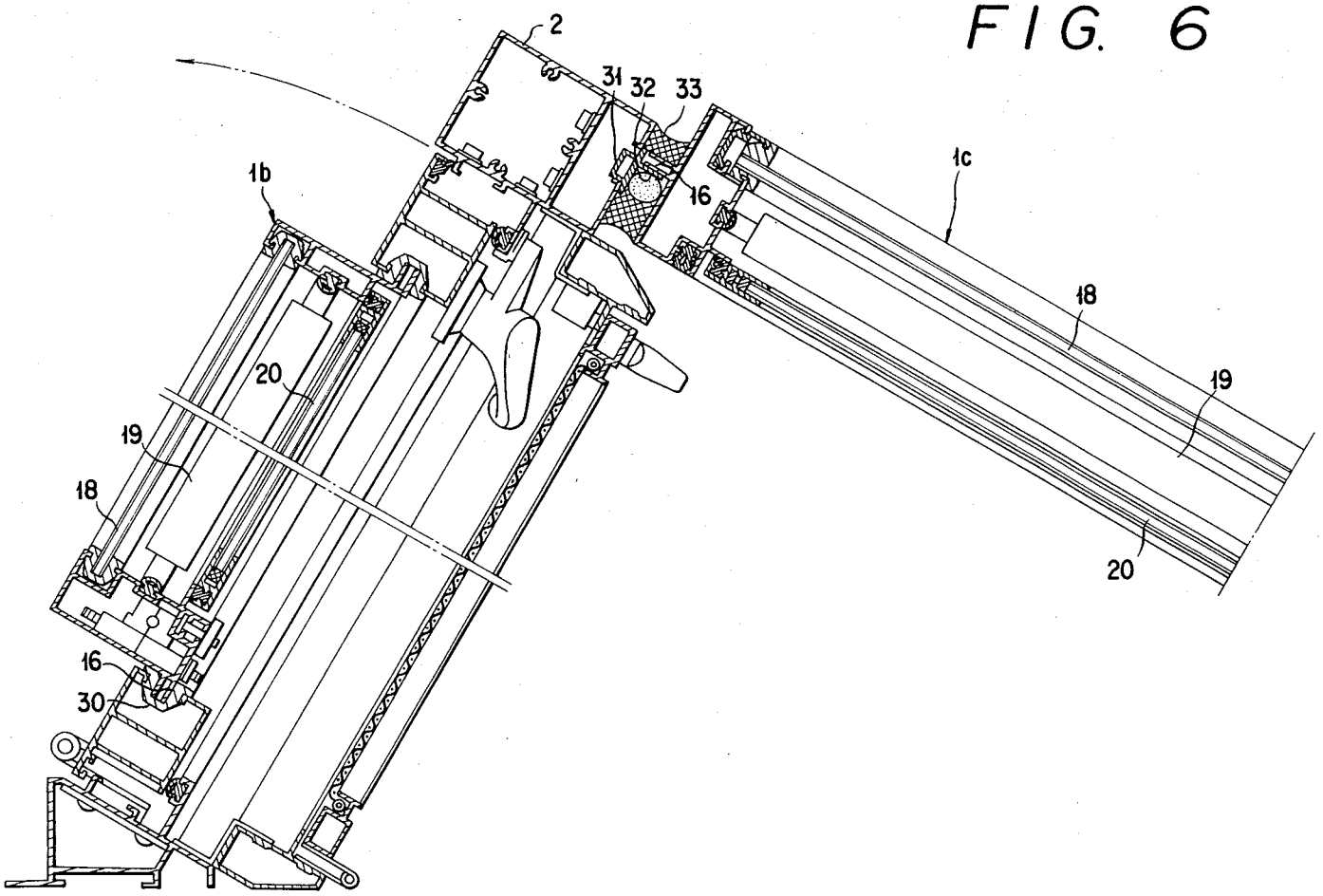
FIG. 6 is a fragmentary cross-sectional view of a screen unit with a built-in blind, in another preferred embodiment, according to the present invention as mounted on an existing window frame for a triangular bay window.
Figure 7:
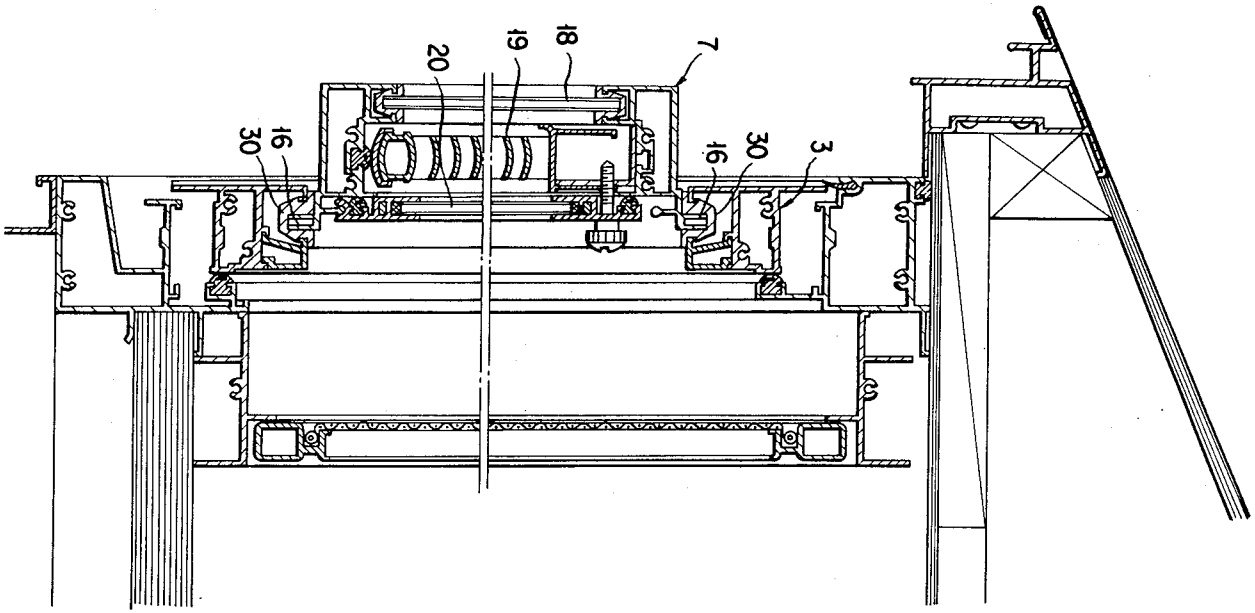
FIGS. 7 is a longitudinal sectional view of the screen unit with a built-in blind of FIG. 6 as applied to a door.
Figure 8:
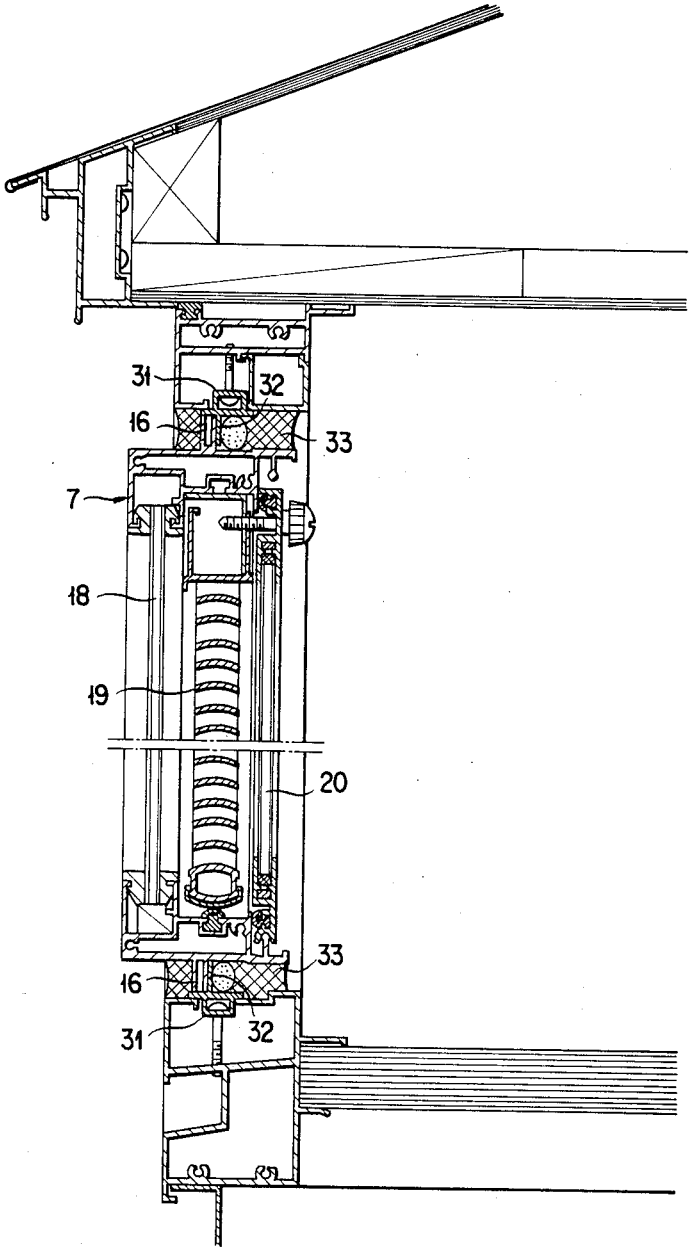
FIG. 8 is a longitudinal sectional view of the screen unit with a built-in blind of FIG. 6 as applied to a fixed sash window.
Figure 9:
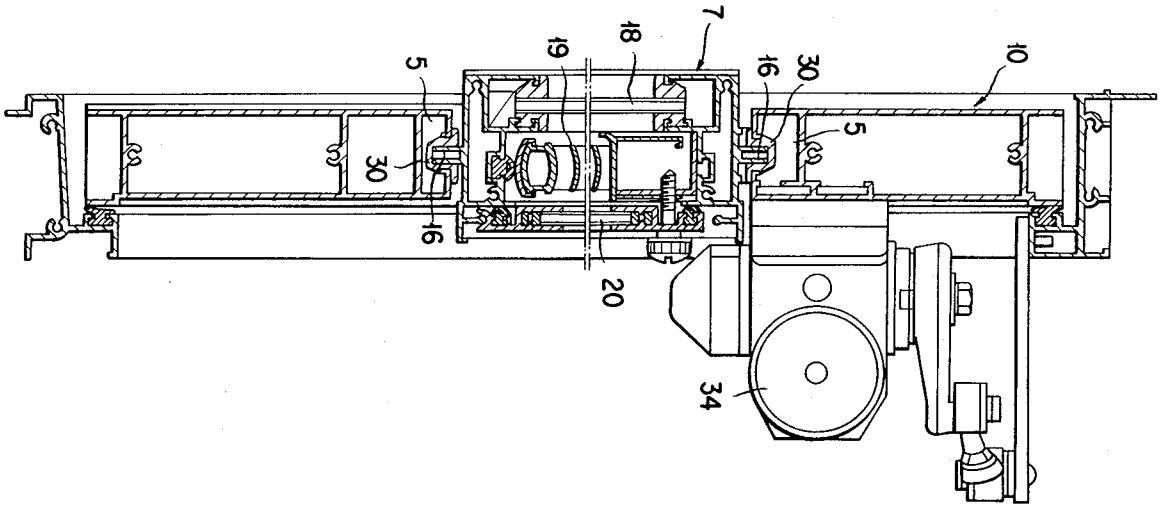
FIGS. 9 and 10 are a longitudinal sectional view and a cross-sectional view, respectively, of a unit screen with a built-in blind according to the present invention as applied to a door for a doorway.
Figure 10:
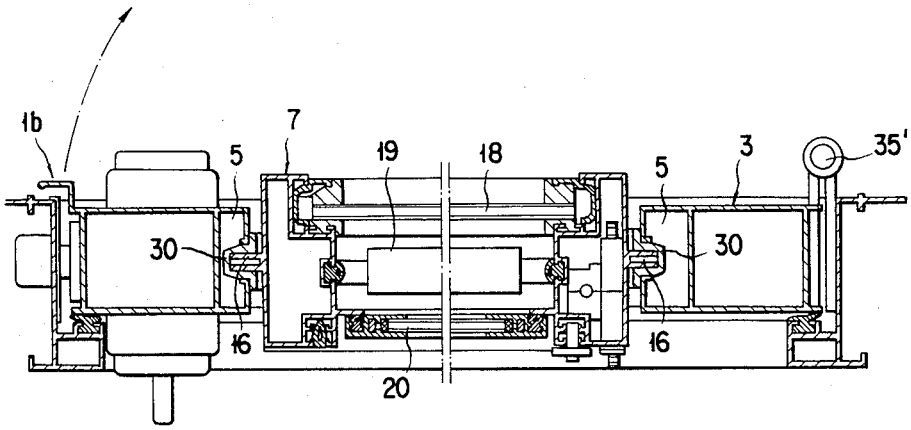
Figure 11:
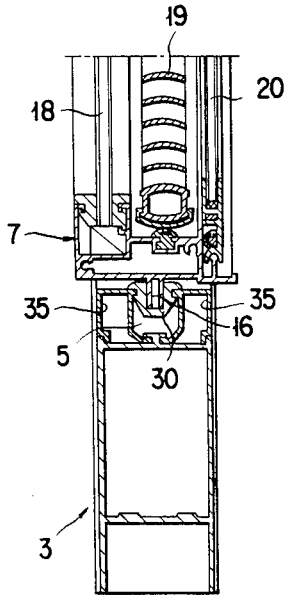
FIG. 11 is a fragmentary longitudinal sectional view of a modification of the screen unit with a built-in blind of FIG. 9.

The present invention is embodied in a screen unit with a built-in blind mounted on an existing sash for a sliding door in FIGS. 1 to 5, in a screen unit with a built-in blind mounted on an existing sash for a triangular bay window in FIGS. 6 to 8, and in a screen unit with a built-in blind mounted on a sash for a door for a doorway in FIGS. 9 to 11. In the following description, the screen units with a built-in blind are referred to as a sliding door 1*a*, a door 1*b* or a fixed sash window 1*c*, respectively. On the other hand, an existing sliding door, an existing door and an existing fixed window mounted on an existing sash frame or an existing window or door frame are referred to generally as a glass screen unit 1.

Referring to FIGS. 1 to 5 showing sashes for double sliding doors, there are shown an existing sash frame (door frame) 2, a existing door frame 3 for an indoor side sliding door 1*a*, and a existing door frame 4 for an outdoor side sliding door 1*a*. The existing door frames 3 and 4 are provided respectively with grooves 5 and 6 each for receiving a glass panel in the inner circumferences thereof. The upper horizontal frame member 8, lower horizontal frame member 9, right vertical frame member 10 and left vertical frame member 11 of a unit frame (door sash) 7 for a screen unit with a built-in blind are basically the same in construction. As shown in FIGS. 3A and 3B, each of the frame members 8, 9, 10 and 11 has a tubular main frame body 12 having a groove 13 for receiving a glass panel, formed in the outdoor side in the inner surface thereof, a blind holding portion 14 formed in the middle portion thereof, a glass panel member holding portion 15 formed in the indoor side thereof, and an elongate projection 16 to be received in the groove 5 (6) of the existing door frame 3 (4), formed in the outer surface thereof. The elongate projection 16 may be formed of a pair of ribs 16 as shown in FIG. 3A or a hollow rib 16 as shown in FIG. 3B.

A supporting rail 17 is formed in the glass panel member holding portion 15 of the lower horizontal frame member 9. The inner portions of the upper and lower ends of the vertical frame members 10 and 11 are cut away partly, and then the upper horizontal frame member 8 and the lower horizontal frame member 9 (the opposite ends of the supporting rail 17 are cut away) are connected at right angles respectively to the upper ends and lower ends of the vertical frame members 10 and 11 and are fastened to the vertical frame members 10 and 11 with screws to form the unit frame 7 of the screen unit. An outdoor side glass panel 18 is retained firmly by a glass retaining member 30 fitted in the grooves 13 continuously formed in the inner circumference of the unit frame 7 in the outdoor side of the same. A blind 19 is suspended from the blind holding portion 14 of the upper horizontal frame member 8. An indoor side glass panel member 20 is placed in the indoor side of the glass panel member holding portion 15. An upper edge strip 21 and a lower edge strip 22 are fitted respectively on the upper and lower edges of the indoor side glass panel member 20. Edge strips similar to the upper and lower edge strips 21 and 22 are fitted on the right and left side edges of the indoor side glass panel member 20. The lower edge strip 22 having a groove 23 in the lower edge thereof is mounted on the supporting rail 17 with the groove 23 receiving the supporting rail 17 therein. The upper edge strip 21 is provided with fastening screws 25 for fastening the upper edge strip 21 to the main frame body of the upper horizontal frame member 8. A sealing member 26 is provided between the upper, lower right side and left side edge strips, and the indoor side surfaces of the main frame bodies 12 of the frame members 8, 9, 10 and 11. The indoor side glass panel member 20 can be turned on or removed from the supporting rail 17 when the fastening screws 25 are unfastened. In a modification of the screen unit with a built-in blind, shown in FIG. 5, the glass panel member holding portions 15 of the upper and lower horizontal frame members 8 and 9 are channel strips. In mounting the indoor side glass panel member 20 on the screen unit, first the upper edge of the indoor side glass panel member 20 is inserted deep in the groove of the upper channel strip, and then the indoor side glass panel member 20 is dropped vertically so that the lower edge of the same is received in the groove of the lower channel strip.

A pull handle 27 and a regulating wheel 28 are provided on the indoor side surface of the unit frame 7 of the screen unit to draw together and raise the slats of the blind 19 suspended between the outdoor side glass panel 18 and the indoor side glass panel member 20 by the pull handle 27 and to regulate the angular position of the slats by the regulating wheel 28.

The unit frame 7 of the screen unit thus assembled has the vertical elongate projections 16 and the horizontal elongate projections 16 extending along and projecting from the peripheral surface thereof. The vertical and horizontal elongate projections 16 are connected at the corners of the unit frame 7 with connecting blocks 29 in the shape of a continuous flange. The continuous flange consisting of the elongate projections 16 is formed at a position corresponding to that of the outdoor side groove 13.

In mounting the screen unit with a built-in blind on the existing glass screen unit 1, the existing door frame 3 (4) of the glass screen unit 1 is disassembled to remove the existing glass panel, and then the door frame 3 (4) is assembled again to mount the screen unit with a built-in blind on the door frame 3 (4). That is, glass retaining members 30 are fitted in the grooves 5 (6) of the door frame 3 (4) after disassembling the door frame 3 (4), and thereafter the elongate projections 16 of the unit frame 7 of the screen unit are fixedly fitted in the grooves 5 (6) through the glass retaining members 30, thereby assembling the door frame 3 (4) again. Thus, the existing glass screen unit 1, namely, the existing sliding door is modified into the screen unit with a built-in blind, namely, the sliding door 1*a*.

Figure 1:
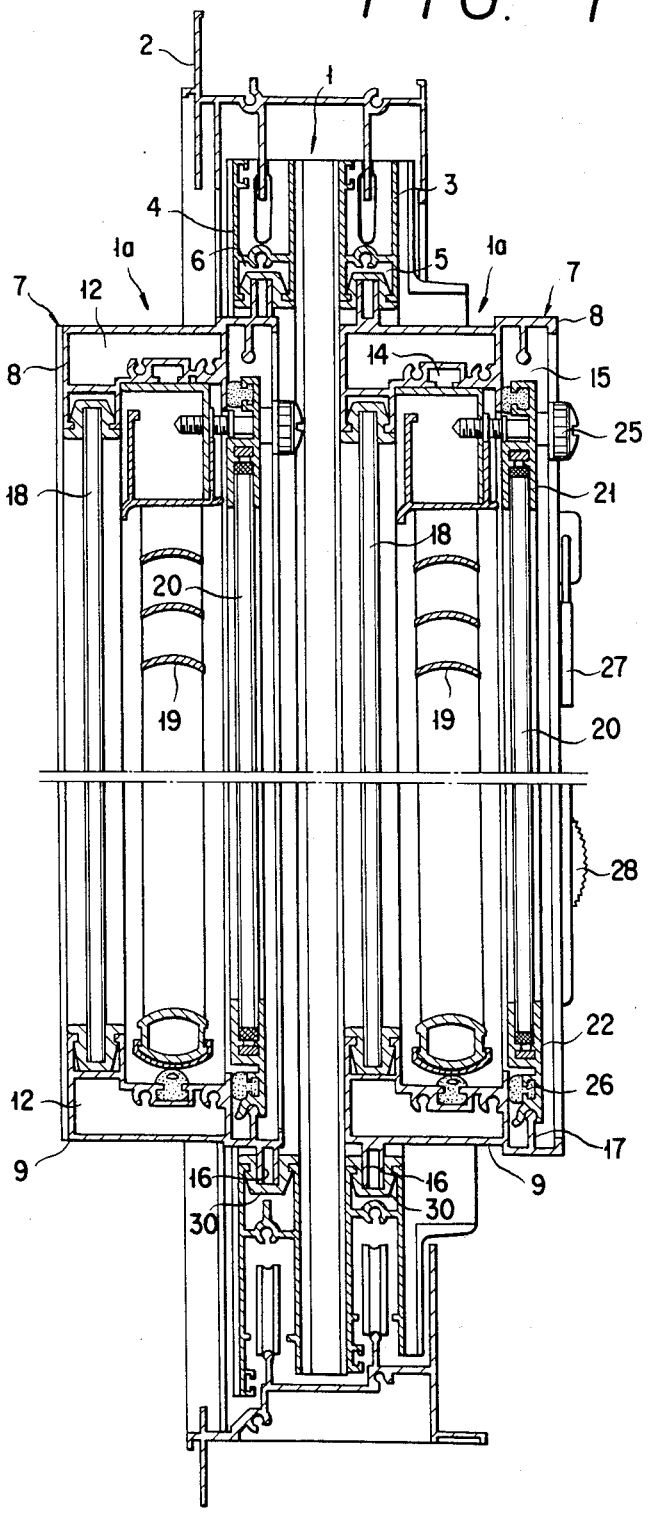
FIG. 1 is a longitudinal sectional view of screen units with a built-in blind, in a preferred embodiment, according to the present invention as mounted on an existing door frame for sliding doors.
Figure 2:
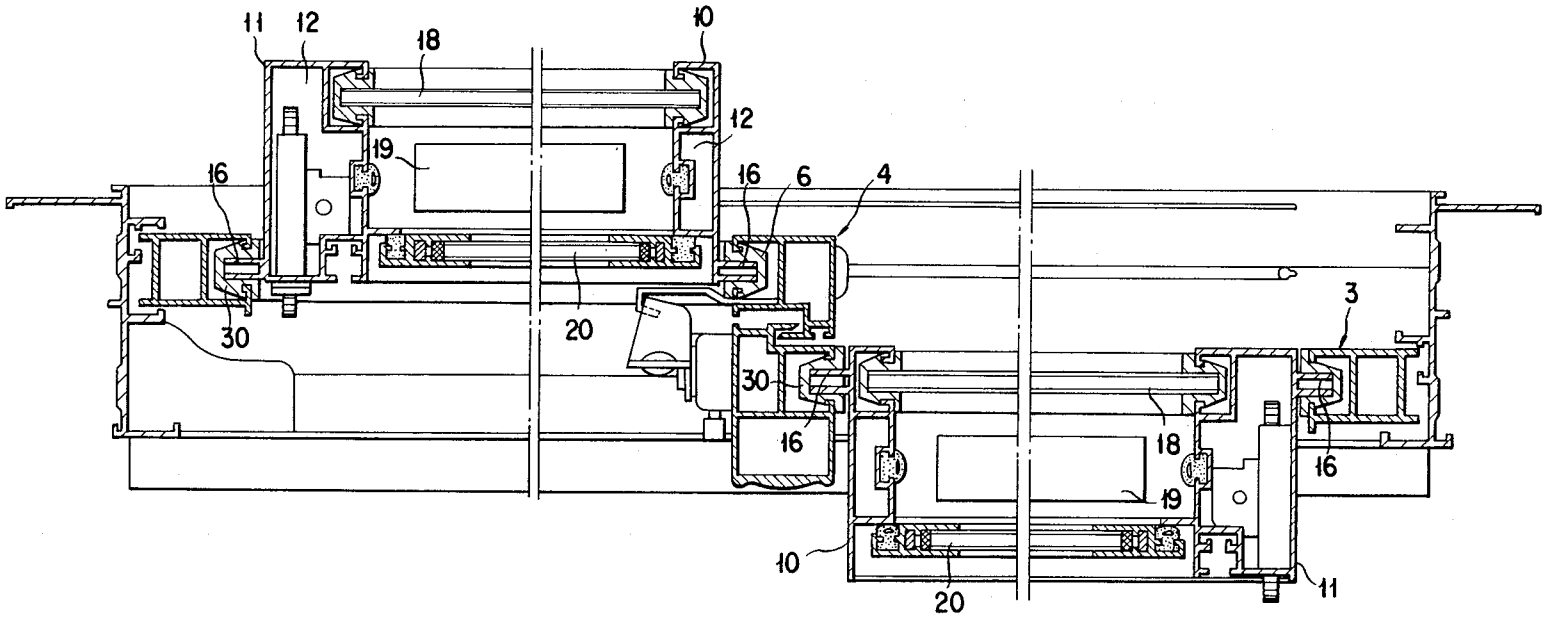
FIG. 2 is a cross-sectional view of the screen units with a built-in blind of FIG. 1.
Figure 3A:
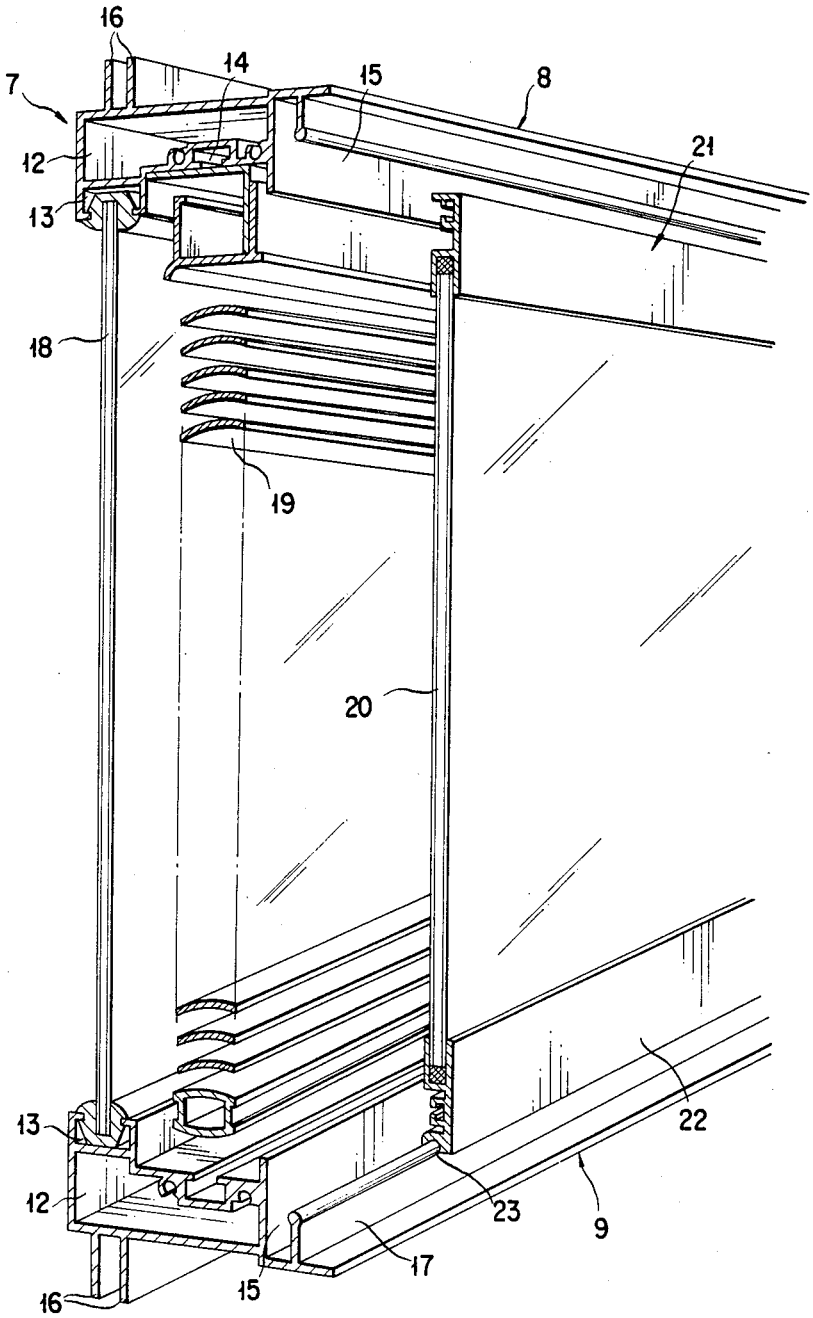
FIG. 3A is a partly cutaway schematic perspective view of the screen unit with a blind shown in FIGS. 1 and 2.
Figure 3B:
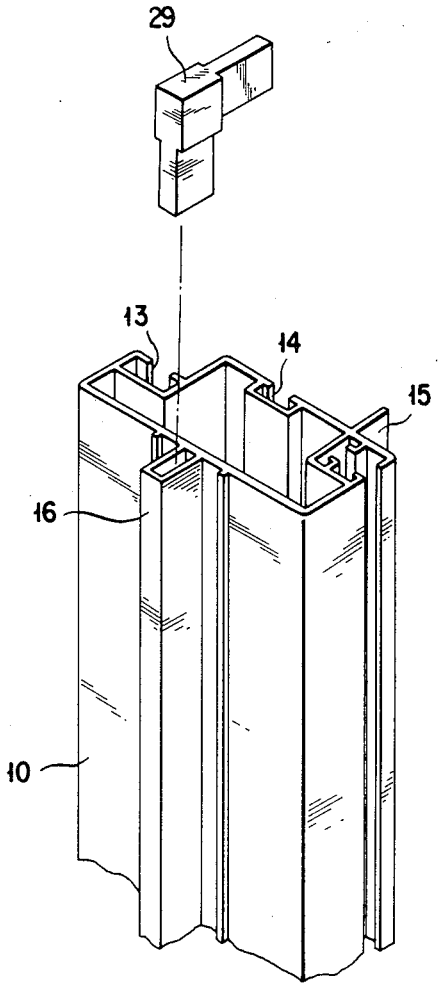
FIG. 3B is a fragmentary schematic perspective view of the vertical frame member of a modification of the screen unit with a built-in blind of FIGS. 1 and 2.
Figure 4:
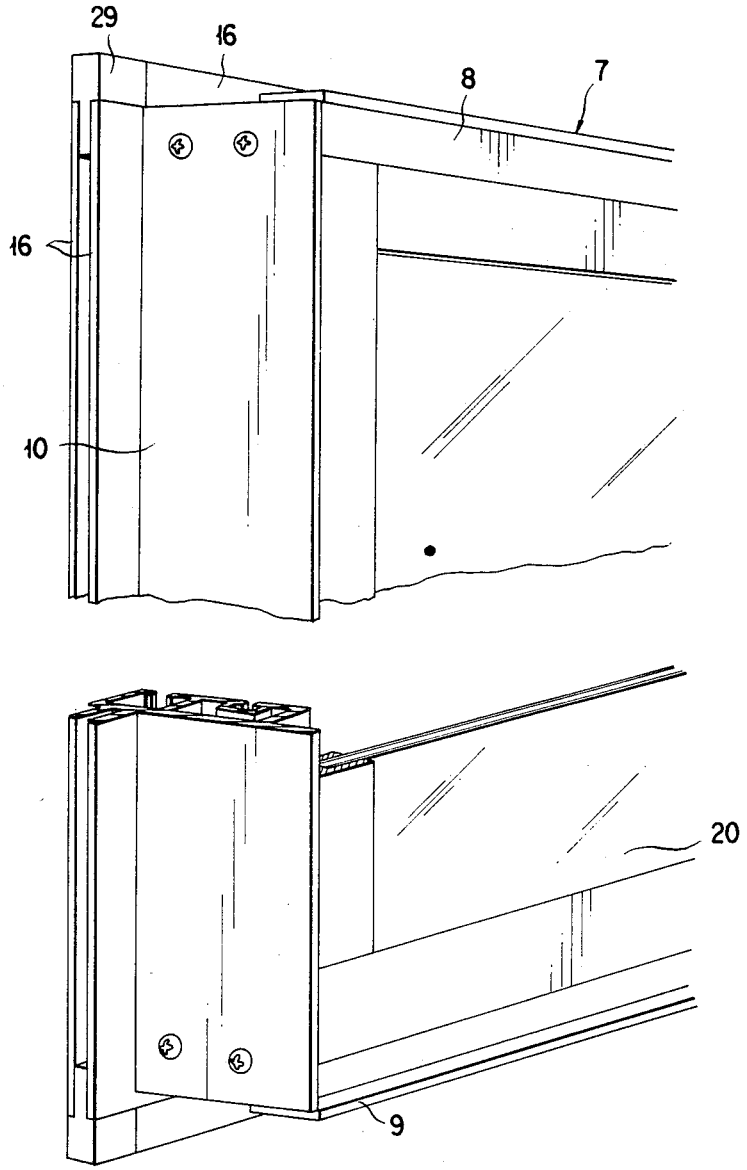
FIG. 4 is a partly cutaway schematic perspective view showing the external morphology of a portion in FIG. 3A.
Figure 5:
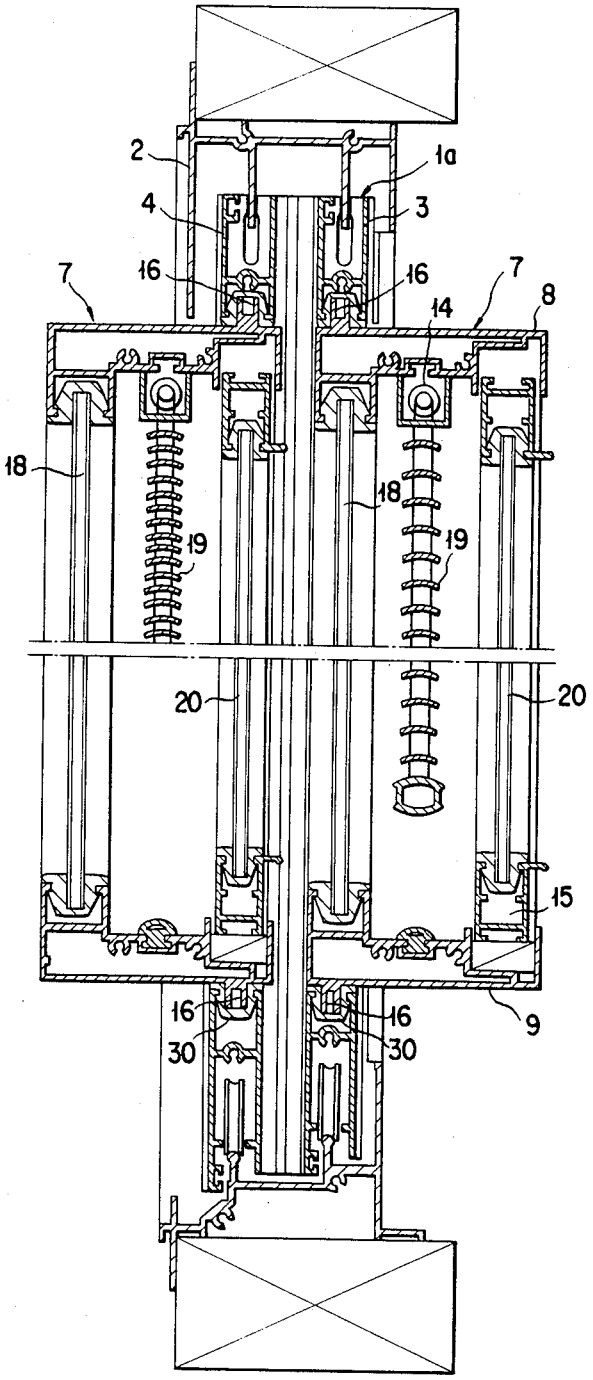
FIG. 5 is a longitudinal sectional view of another modification of the screen unit with a built-in blind of FIG. 1.

As shown in FIGS. 1 and 2, the screen unit with a built-in blind mounted on the door frame 3 of the indoor side glass screen unit 1 protrudes toward the inside of the room, while the screen unit with a built-in blind mounted on the door frame 4 of the outdoor side glass screen unit 1 protrudes toward the outside of the room, so that the door frames 3 and 4 can slide along the rails without interfering with each other.

FIGS. 6 to 8 show screen units with a built-in blind embodying the present invention as applied to a triangular bay window. One of the windows of the triangular bay window is a door 1*b* which opens outward, and the other is a fixed window 1*c*. A screen unit with a built-in blind of the fixed window 1*c* is the same in construction as the foregoing screen unit with a built-in blind. The elongate projections 16 of the unit frame 7 of a screen unit with a built-in blind mounted on the door 1*b* are biased toward the glass panel member holding portion 15 formed in the indoor side of the unit frame 7. The elongate projections 16 of a screen unit with a built-in blind mounted on the existing sash frame (window frame) 2 of the fixed window 1*c* are formed in the middle with respect to the thickness of the frame members at a position substantially corresponding to that of the blind holding portion 14. In fastening the unit screen to the existing sash frame (window frame) 2 of the fixed window 1*c*, an sacrifice frame 31 is fixed to the frame 2 with screws, the elongate projections 16 of the unit frame 7 (window sash) of the screen unit are screwed to a rib 32 projecting from the inner periphery of the sacrifice frame 31, and then a sealing material 33 is filled between the outer periphery of the unit frame 7 of the screen unit and the existing sash frame 2.

The door 1*b* of the triangular bay window may be a vertical slide-out window.

FIGS. 9 and 10 show a screen unit with a built-in blind applied to a door 1*b* for a doorway. The door 1*b* shown in FIGS. 9 and 10 is similar in construction to the foregoing door 1*b* of the triangular bay window shown in FIGS. 6 to 8. In FIGS. 9 and 10, indicated at 34 is a door check, and at 35' is a hinge. FIG. 11 shows a modification of the door 1*b* for a door way. This door 1*b* is different from the door 1*b* shown in FIGS. 9 and 10 in that the door frame 3 of the door 1*b* has grooves 5 for receiving a glass panel, each formed of a pair of battens 35, 35 fixed to the door frame 3 respectively in the outdoor side and the indoor side.

We claim:

1. A screen unit with a built-in blind, comprising:

an existing sash;

a rectangular unit frame formed of an upper horizontal frame member, a lower horizontal frame member, a right vertical frame member and left vertical frame member;

an outdoor side glass panel fixedly mounted on the unit frame in the outdoor side of the same;

an indoor side glass panel member detachably mounted on the unit frame in the indoor side of the same;

a blind disposed between the outdoor side glass panel and the indoor side glass panel member; and a flange formed integrally with the unit frame so as to extend along and project from the periphery of the unit frame, for engagement with a frame for an existing sash, said flange being fastened to a sacrifice frame fixed to said existing sash frame.

2. A screen unit with a built-in blind according to claim 1, wherein each of the frame members of said unit frame has a tubular main frame body having a groove for receiving a glass panel, formed in the outdoor side in the inner surface thereof, a blind holding portion formed in the middle portion thereof, and a glass panel member holding portion for holding said indoor side glass panel member, formed in the indoor side thereof.

3. A screen unit with a built-in blind according to claim 2, wherein said glass panel member holding portion includes a single supporting rail provided in the indoor side of the lower horizontal frame member of said unit frame.

4. A screen unit with a built-in blind according to claim 2, wherein said glass panel member holding portion is formed in the shape of a groove for receiving said indoor side glass panel member.

5. A screen unit with a built-in blind according to claim 1, wherein said flange comprises right and left vertical elongate projections and upper and lower horizontal elongate projections, and said right and left vertical elongate projections and said upper and lower horizontal elongate projections being connected to each other at the respective opposite ends thereof by connecting blocks respectively.

6. A screen unit with a built-in blind, comprising:

an existing sash frame;

a rectangular unit frame formed of an upper horizontal frame member, a lower horizontal frame member, a right vertical frame member and left vertical frame member;

an outdoor side glass panel fixedly mounted on the unit frame in the outdoor side of the same;

an indoor side glass panel member detachably mounted on the unit frame in the indoor side of the same;

a blind disposed between the outdoor side glass panel and the indoor side glass panel member; and a flange formed integrally with the unit frame so as to extend along and project from the periphery of the unit frame, for engagement with a frame for an existing sash, said flange being fixed in a groove for receiving a glass panel, provided in said existing sash frame.

7. A screen unit with a built-in blind according to claim 6, wherein said groove for receiving a glass panel, provided in said existing sash frame is formed by arranging a pair of battens being in parallel to each other and fixedly fitted into said existing sash frame, respectively, on the outdoor side and the indoor side.

8. A screen unit with a built-in blind according to claim 5, wherein each of said vertical and horizontal elongate projections is formed at a position corresponding to said indoor side glass panel member in case the screen unit with a built-in blind is to be installed on the outdoor side, and each of said vertical and horizontal elongate projections is formed at a position corresponding to said outdoor side glass panel in case the screen unit with a built-in bline is to be installed on the indoor side.

9. A screen unit with a built-in blind according to claim 5, wherein each of said vertical and horizontal elongate projections is formed at a position corresponding to said blind disposed between said outdoor side glass panel and said indoor side glass panel member.

10. A screen unit with a built-in blind, comprising:

an existing sash frame;

a rectangular unit frame formed of an upper horizontal frame member, a lower horizontal frame member, a right vertical frame member and left vertical frame member;

an outdoor side glass panel fixedly mounted on the unit frame in the outdoor side of the same;

an indoor side glass panel member detachably mounted on the unit frame in the indoor side of the same;

a blind disposed between the outdoor side glass panel and the indoor side glass panel member; and a flange formed integrally with the unit frame so as to extend along and project from the periphery of the unit frame, for engagement with said frame for an existing sash, said flange comprising right and left vertical elongate projections and upper and lower horizontal elongate projections, and said right and left vertical elongate projections and said upper and lower horizontal elongate projections being connected to each other at the respective opposite ends thereof by connecting blocks respectively, each of said vertical and horizontal elongate projections being formed of two parallel ribs.

11. A screen unit with a built-in blind, comprising:

an existing sash frame;

a rectangular unit frame formed of an upper horizontal frame member, a lower horizontal frame member, a right vertical frame member and left vertical frame member;

an outdoor side glass panel fixedly mounted on the unit frame in the outdoor side of the same;

an indoor side glass panel member detachably mounted on the unit frame in the indoor side of the same;

a blind disposed between the outdoor side glass panel and the indoor side glass panel member; and a flange formed integrally with the unit frame so as to extend along and project from the periphery of the unit frame, for engagement with said frame for an existing sash, said flange comprising right and left vertical elongate projections and upper and lower horizontal elongate projections, and said right and left vertical elongate projections and said upper and lower horizontal elongate projections being connected to each other at the respective opposite ends thereof by connecting blocks respectively, each of said vertical and horizontal elongate projections being formed of a hollow rib.

* * * * *